United States Patent [19]

Naka et al.

[11] Patent Number: 4,593,493

[45] Date of Patent: Jun. 10, 1986

[54] ACCESS DOOR

[75] Inventors: Hiromitsu Naka; Takehiko Okushima; Tatsuo Shoji, all of Yashio, Japan

[73] Assignee: Kabushiki Kaisha Naka Gijutsu Kenkyusho, Tokyo, Japan

[21] Appl. No.: 619,270

[22] Filed: Jun. 11, 1984

[30] Foreign Application Priority Data

Jun. 16, 1983 [JP] Japan ..... 58-108355

[51] Int. Cl.[4] ..... E05D 15/40

[52] U.S. Cl. ..... 49/248; 49/395; 49/401; 49/504; 52/475

[58] Field of Search ..... 49/394, 395, 388, 401, 49/400, 248, 246, 463, 504, 348; 52/204, 475, 210

[56] References Cited

U.S. PATENT DOCUMENTS

| | | | |
|---|---|---|---|
| 3,274,735 | 9/1966 | Stackhouse | 49/504 |
| 3,375,627 | 4/1968 | Bursiek et al. | 49/504 X |
| 3,686,795 | 8/1972 | La Barge | 49/504 X |
| 4,098,024 | 7/1978 | Naka | 49/246 |
| 4,237,663 | 12/1980 | Storer | 49/394 X |
| 4,443,973 | 4/1984 | Naka | 49/388 X |

*Primary Examiner*—Philip C. Kannan

*Attorney, Agent, or Firm*—Wenderoth, Lind & Ponack

[57] ABSTRACT

An access door to be installed on the ceiling or the like of a building which essentially comprises an outer square frame adapted to be installed in an opening formed at said installation area; an inner square frame pivotally connected to said outer frame for movement between open and closed positions; a pair of link hinge means provided on each of two selected sides of said outer frame to pivotally connect said frame to said outer frame; and a lock means for locking said inner frame to said outer frame as the inner frame is in its closed position.

The inner frame has a joint finishing flange at the peripheral edge thereof to conceal the peripheral edge of said outer frame as the inner frame is in its closed position. Also, each of the link hinge means essentially comprises a pair of parallel long links in which the leading end of the lower link has a swing control arm, a short follower link for pivotally connecting the leading ends of the long links, a link guide upwardly pushing the swing control arm as the inner frame is closed, and a bracket connecting the long links together and securing the link hinge means to the outer frame.

4 Claims, 36 Drawing Figures

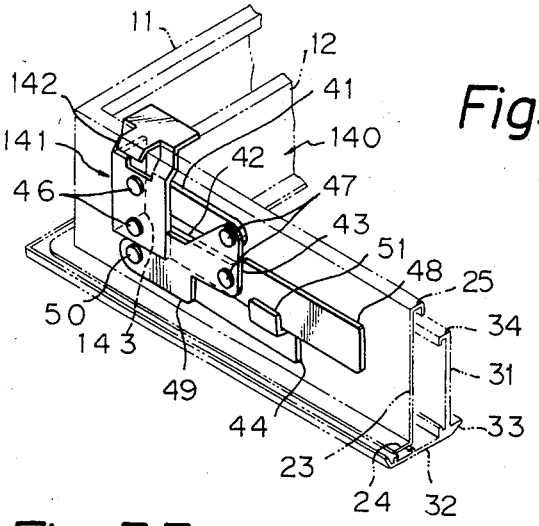
Fig. 32
Fig. 33
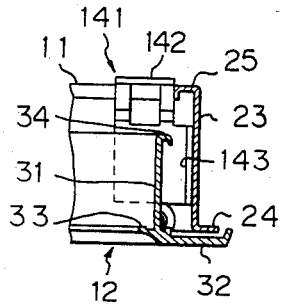
Fig. 34
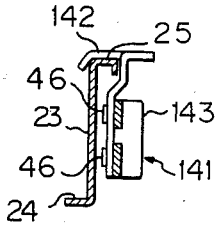
Fig. 35
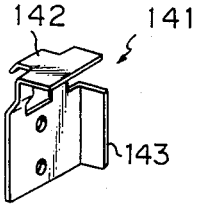
Fig. 36
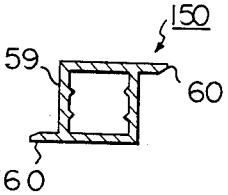

ACCESS DOOR

BACKGROUND OF THE INVENTION

This invention relates to an access door to be installed on a selected ceiling slab, side wall or shaft of a building to allow workers access to piping, wiring and air duct systems and other facilities installed between ceiling and floor slabs, between side walls and or within shafts for inspection and/or repair thereof.

As will be easily understood and precisely grasped from the description given hereinafter, in brief, in the access door of the present invention, an inner square frame is disposed within and pivotally connected to the frame opening defined by an outer square frame disposed within an opening formed at an installation area such as a building ceiling or side wall for movement between open and closed positions, the inner frame comprises a joint finishing flange at the peripheral edge of the frame member so as to conceal the peripheral edge of the outer frame on the outer surface of the installation area when the inner square frame is in its closed position, a pair of link hinge means is provided on each of two selected opposing sides of the outer frame and includes means for pivotally connecting the inner square frame to outer square frame, the inner square frame is rotatable with respect to the outer frame with the center of rotation of the inner frame positioned adjacent to one of the two other sides of the outer square frame to provide a single joint finishing structure whereby when the inner frame is opened the access door is opened at an increased area, the applicability of the access door to various ceiling is enhanced and the versatility of the access door is increased.

And in the access door of the present invention, the outer square frame comprises an assembly of two frame members each defining one half of the frame opening to be defined by the outer frame and connected together by butt joint to thereby increase the rigidity of the outer frame and more particularly, the rigidity of the outer frame for air tight and smooth opening and closing movement of the inner square frame.

Furthermore, in the access door of the present invention, a trim means positioned between an opening formed in a building ceiling, side wall or the installation area for the access door and the outer square frame to increase the application range of the access door whereby the access door can be suitably applied to building ceiling constructed by the so-called exposed, concealed and dry wall processes.

One of the conventional access doors such as a ceiling access door, for example, comprises an outer frame fitted in an opening in a building ceiling and secured to the ceiling by means of fasteners, an inner frame positioned within the frame opening defined by the outer frame and rotatably connected to the outer frame by means of a shaft and bearings and a cover plate or door attached to the inner frame to close the frame opening defined by the inner frame. When the cover is in its closed position, the cover is locked to the outer frame by means of a cremone lock and allowed to rotate about the shaft and bearings downwardly from the closed position to the open position.

In the conventional ceiling access door having the components constructed and arranged in the manner mentioned above, the outer frame is usually formed by cutting a cold rolled shaped steel or aluminum alloy blank of indefinite length into four frame members of a predetermined length and connecting the frame members together by use of corner pieces or alternatively, by roll formed steel or aluminum alloy into shaped blanks of indefinite length with grooves, cutting the blank into four frame members each having grooves at the opposite ends of a predetermined length, connecting the four frame members together in a square formation by butt joint and driving corner pieces into the grooves at the ends of the frame members associated with each other to provide an assembly. Alternatively, a frame member blank is cut into four frame members of a predetermined length, the four frame members are connected together by butt joint and spot welded together at the corners defined by the abutting frame members.

Since the outer frame in the conventional access door is formed by any one of the above-mentioned three types of processes, the assembling operation efficiency of the outer frame is low, the frame members are not always precisely butt jointed resulting in a non-uniform product and furthermore, since the outer frame has a number of connected points it is difficult to provide an air-tight outer frame having sufficient rigidity.

And since the inner frame having the cover attached thereto is rotatably or pivotally connected to the outer frame through the shaft and bearings when the access door is opened, the opening area of the access door or the open area of the frame opening defined by the outer frame is subjected to limitation and the area of the outer and inner frames appearing on the ceiling surface is a double-joint finishing structure instead of a single-joint finishing structure. Furthermore, the conventional access door had to be produced to be suitably employed in a particular ceiling structure or made to order and lacked in versatility.

SUMMARY OF THE INVENTION

Thus, the purpose of the present invention is to provide an access door to be installed on a building ceiling or side wall which has an enhanced rigidity and particularly has an enhanced outer frame rigidity and a fewer number of connected points to thereby provide a single joint finishing structure, which opens and closes smoothly, which increases the area of the opening in the access door, which increases the productivity of it, which decreases the cost of production for it, and which has an enhanced versatility to make it applicable to various ceiling and side wall structures.

In order to attain the above purposes, the access door of the present invention comprises an outer frame adapted to be disposed at an installation area such as an opening formed in a building ceiling or side wall, an inner frame disposed within the frame opening defined by the outer frame and pivotally connected to the outer frame for rotation between open and closed positions, said inner frame having a joint finishing flange at the peripheral edge to conceal the peripheral edge of said outer frame on the outer surface of said installation area when the inner frame is in its closed position, a cover plate attached to said inner frame to close the frame opening defined by said inner frame, a pair of link hinge means provided on each of two selected sides of said outer frame to pivotally connect said inner frame to said outer frame, a lock means for locking said inner frame to said outer frame when the inner frame is in its closed position, said outer frame being formed by assembling two outer frame members together in a square formation by butt joint, and a trim means disposed between said installation opening and outer frame.

The above-mentioned outer frame is preferably formed by assembling two channel cross-section outer frame members each defining one half of the frame opening to be defined by the outer frame such as U-shaped cross-section or L-shaped frame members together by butt joint so as to keep away from the four corners of the outer frame.

Important advantages to be obtained by the access door of the invention are that substantially the whole area of the opening in the access door is uncovered when the access door is opened for enhancement of inspection and repair operation efficiency on piping, wiring and air duct systems and other facilities within the ceiling of a building, that the access door can be easily assembled as a single joint finishing structure, that the frames and especially, the outer frame is enhanced in its rigidity resulting in an air-tight structure, that the access door can be easily adaptable to ceiling structures constructed by the so-called exposed, concealed and dry wall processes as well as ordinary ceilings and side walls and that the access door can be newly installed, installed in addition to existing access doors and removed with ease.

Thus, according to the present invention, the inner square frame is provided at the peripheral edge with a joint finishing flange to conceal the peripheral edge of the outer frame when the inner square frame is in its closed position, a pair of link hinge means is provided on each of two selected sides of the outer square frame to pivotally connect the inner square frame to the outer square frame and more particularly, the inner square frame is rotatable with respect to the outer frame with the axis of rotation of the inner frame positioned adjacent to one of the two other sides of the outer square frame, the outer square frame consists of two members each defining one half of the frame opening to be defined by the outer frame and connected together by butt joint and a trim means is disposed between the installation opening in the building ceiling or side wall and the outer frame and thus, the adaptability of the access door to various ceilings, side walls and shafts is enhanced so that the access door can be advantageously applied to various buildings and especially, the ceilings of such buildings constructed by the so-called exposed, concealed and dry wall processes and suitably and advantageously applied to buildings where many people reside.

BRIEF DESCRIPTION OF THE DRAWINGS

FIG. 32 is a perspective view of a further modified link hinge means useful for the ceiling access door of the present invention;

FIG. 33 is a back view of the bracket employed in said link hinge means as shown in FIG. 32;

FIG. 34 is a rear end elevational view of said bracket as shown in FIG. 33;

FIG. 35 is a perspective view of said bracket as shown in FIGS. 33 and 34; and

FIG. 36 is a cross-sectional view of one of the trim members forming a modified trim useful for the ceiling access door of the present invention.

PREFERRED EMBODIMENT OF THE INVENTION

The present invention will be now described referring to the accompanying drawings in which one preferred embodiment of the access door of the present invention is shown.

FIGS. 1 to 15 inclusive illustrate the access door 10 of the invention as being embodied as a ceiling access door to be installed on the ceiling 160 of an office building constructed by the so-called concealed process.

The ceiling access door 10 is secured to an opening 164 formed at the installation area in the building ceiling 160 for the purpose by means of four hangers 18.

Figure 5:
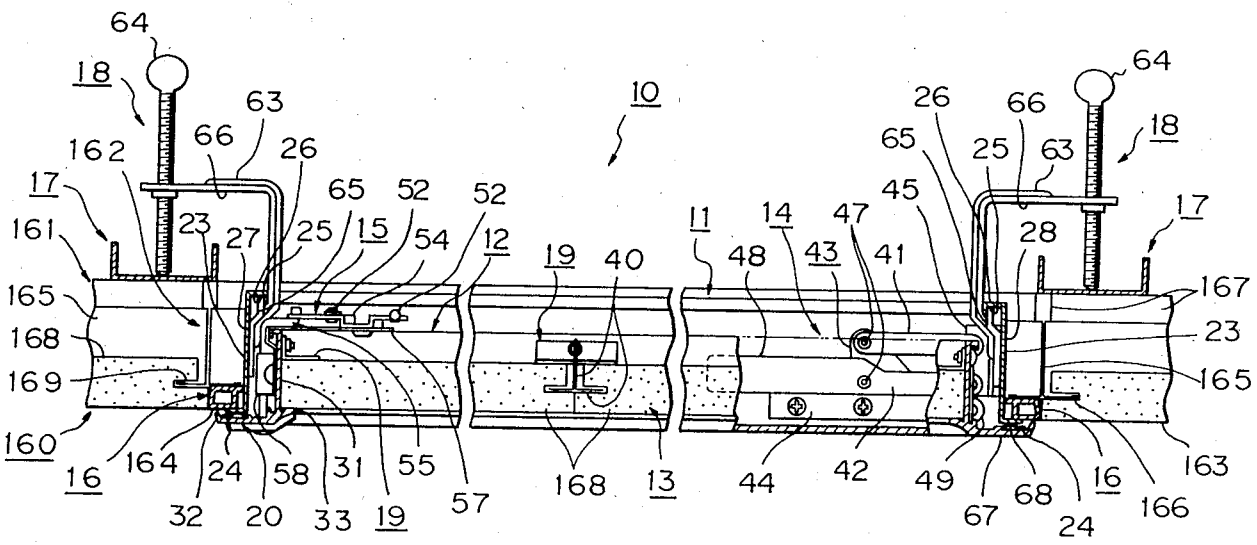
FIG. 5 is a cross-sectional view taken along the line 5—5 of FIG. 4.

As most clearly shown in FIG. 5, the ceiling 160 having the ceiling access door 10 of the invention installed thereon comprises a plurality of flanged main beams 161 extending in a predetermined spaced relationship between opposing wall mouldings of a plurality of wall mouldings (not shown) secured in a square formation to walls of the building, said main beams being hung in suitable positions thereof from ceiling slabs by means of hanger wires or rods (not shown), for example, a plurality of cross beams 162 extending in a predetermined spaced relationship between the main beams 161 and wall mouldings at right angles to the main beams so as to form a ceiling framework in cooperation therewith and a ceiling wall 163 assembled to the ceiling framework in a suitable position of the framework to form a selected grid of the ceiling framework as an opening 164. The ceiling wall 163 consists of a plurality of ceiling tiles 168 each having kerfs 169 on the opposite side faces and at the opposite end faces thereof so that the ceiling wall 163 is assembled to the ceiling framework by inserting the flanges 166 on the main and cross beams 161, 162 into the kerfs 169 and inserting ribbed splines (not shown) into between the kerfs in the side faces of adjacent ceiling tiles where the tiles are butted against each other to provide the ceiling wall 163.

Each of the main and cross beams 161, 162 which form the ceiling framework, of course, consists of a web 165, the above-mentioned flange 166 integrally formed with the lower edge of the web 165 and a bulb 167 integrally formed with the upper edge of the web 165.

Figure 1:
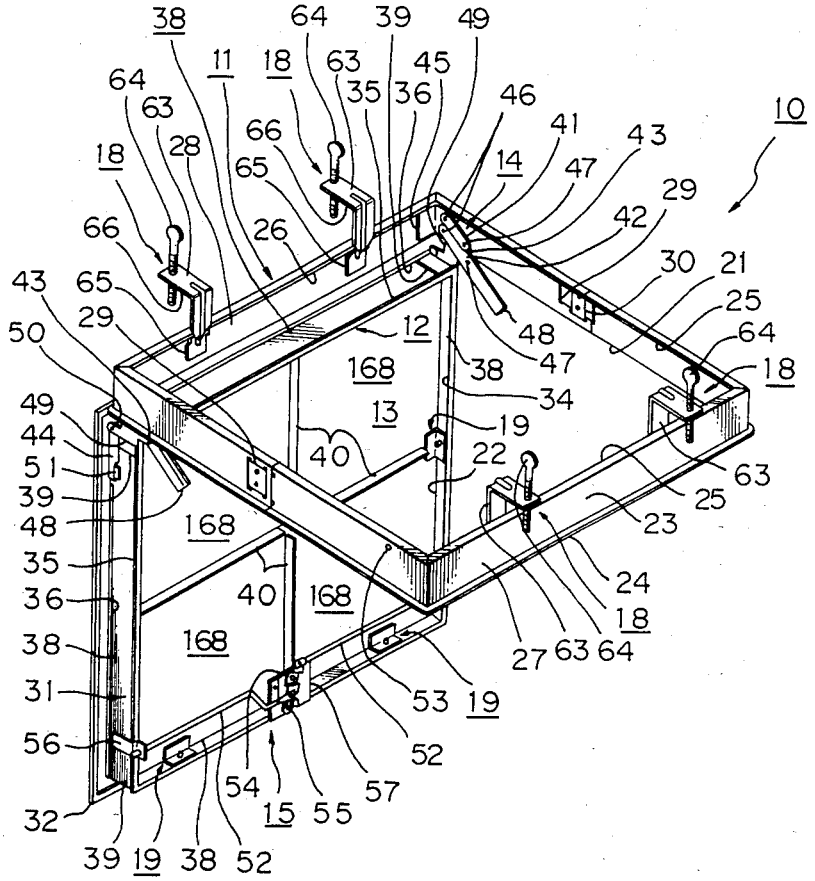
FIG. 1 is a perspective view of one preferred embodiment of the ceiling access door constructed in accordance with the principle of the present invention as applied to the ceiling of an office building showing the door in its open position.
Figure 2:
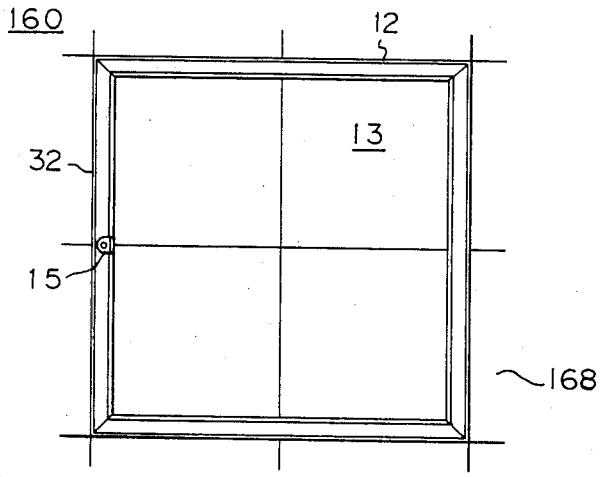
FIG. 2 is a plan view of the outer side of said ceiling access shown in FIG. 1 showing the door in its closed position.
Figure 3:
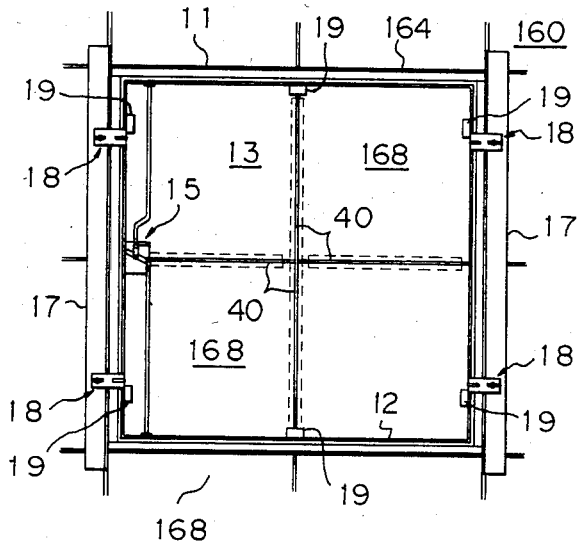
FIG. 3 is similar to FIG. 2, but shows the inner side of said ceiling access door.
Figure 10:
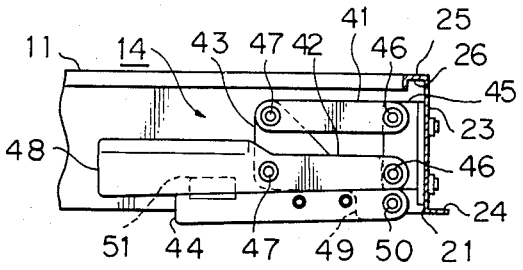
FIG. 10 is a front elevational view of said link hinge means as shown in FIG. 6 when the ceiling access door of FIG. 1 is in its closed position.
Figure 11:
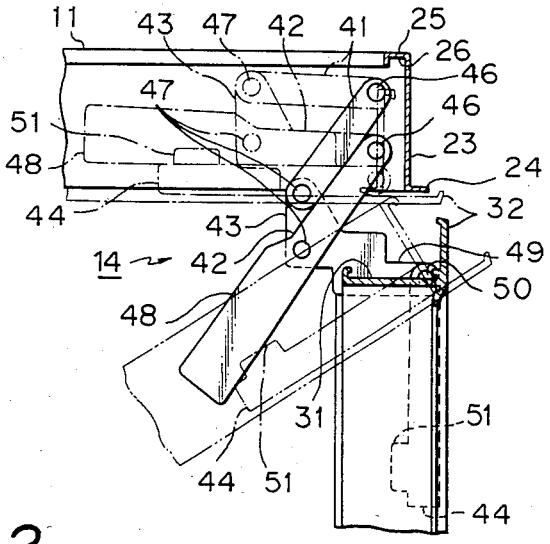
FIG. 11 is a front elevational view of said link hinge means as shown in FIG. 6 when the ceiling access door of FIG. 1 is in its open position.
Figure 12:
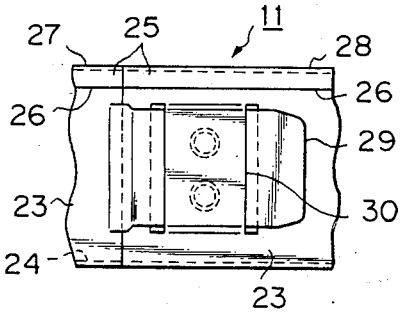
FIG. 12 is a fragmentary front elevational view of the butt joint between the outer frame members forming the outer square frame employed in said ceiling access door as shown in FIG. 1.

The ceiling access door 10 installed on the ceiling 160 comprises an outer square frame 11 fitted in the selected grid or opening 164 in the ceiling framework and hung by means of four hangers 18 from two auxiliary channel members 17 bridging between and secured to the main beams 161, an inner square frame 12 disposed in the frame opening 21 defined by the outer square frame 11 and pivoted to the outer frame for moving or rotating between opened and closed positions relative to the outer frame, a cover plate 13 secured to the inner square frame 12 by means of a plurality of fasteners 19 to close the frame opening 22 defined by the inner square frame 12, a pair of link hinge means 14 secured to each of two opposing sides of the outer frame 11 and pivotally connecting the inner frame 12 to the outer frame 11, locking means 15 secured to one of the two other sides of the outer frame 11 for locking the inner frame 12 to the outer frame 11 when the inner frame is in its closed position and trim 16 is disposed between the flanges 166 on the main and cross beams 161, 162 forming the grid and the associated ends of the outer frame 11 whereby when the assembly of the inner frame 12 and cover plate 13 and more particularly, the cover plate 13 of the assembly is in its closed position (as shown in FIGS. 2 to 5 and 10) the cover plate is locked to the outer frame 11 by the locking means 15 and when the locking means is unlocked the cover plate is allowed to swing or rotate downwardly to the open position (as shown in FIGS. 1 and 11) by means of the link hinge means 14.

The outer square frame 11 consists of a pair of channel cross-section outer frame members or U-shaped outer frame members 27, 28 connected together in butt joint and each defining one half of the frame opening 21, respectively.

Each of the outer frame members 27, 28 is produced by rolling a steel plate or strip of indefinite length to the cross-sectional configuration as shown in FIGS. 1, 5, 10 and 12, cutting the rolled steel plate into frame member blanks of a predetermined length and then bending the cut frame member blanks to the U-shape. As more clearly shown in FIGS. 1 and 12, the outer frame member 27 has connector tongues 29 at the opposite ends formed by pressing whereas the outer frame member 28 has lanced bridges 30 at the opposite ends, respectively, whereby when the outer frame members 27, 28 are connected together in butt joint the connector tongues 29 are received in the lanced bridges 30 and then the connector tongues 29 and the lanced bridges 30 are caulked with each other by pressing to connect the outer frame members 27, 28 together.

The outer frame 11 consisting of the frame members 27, 28 connected together in this manner further comprises an outwardly extending flange 24 at the lower end of a web 23 and an inwardly extending lipped flange 25 at the upper end of the web 23. The inwardly extending flange 25 forms a groove 26 in cooperation with the frame web 23 for receiving the hangers 18.

Alternatively, each of the above-mentioned outer frame members 28 may be formed at one end with a connector tongue 29 and at the other end a lanced bridge 30 formed by pressing within the scope of the present invention.

Figure 13:
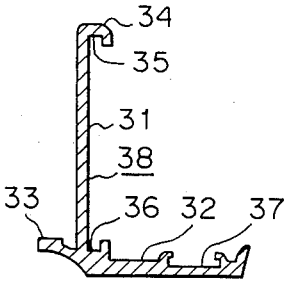
FIG. 13 is a cross-sectional view of one of the inner frame members forming the inner square frame employed in said ceiling access door as shown in FIG. 1.

The inner square frame 12 consists of four aluminum alloy inner frame members 38 assembled together in a square formation. The frame members 38 are produced by extruding aluminum alloy into a frame member blank of indefinite length having the cross-sectional configuration as shown in FIG. 13 and cutting the blank into frame members of a predetermined length. That is, the inner frame members 38 are then abuttedly connected together in butt joint in the square frame formation as shown in FIG. 1 and corner pieces 39 are then pressed into the insertion grooves 35, 36 in the members 38 where the frame members are connected together in butt joint to thereby provide the inner square frame 12. Four corner pieces 39 are employed to assemble the inner frame members 38 and the corner pieces 39 are produced by pressing steel plate blanks into a triangular shape.

The inner frame 12 comprising the four inner frame members 38 assembled in the manner mentioned above further includes a joint finishing flange 32 and a retention flange 33 at the lower end of a web 31. The joint finishing flange 32, of course, extends outwardly from the web 31 and is disposed to cover in the frame opening 21 defined by the outer frame 11. The dimensions of the joint finishing flange 32 are so selected that when the frame opening 21 is closed the joint finishing flange 32 conceals the outwardly extending flange 24 of the outer frame 11 and the ceiling access door 10 appears as having one joint on the ceiling surface. The joint finishing flange 32 also has a lipped groove 37 in the upper surface thereof for receiving a packing 20. The packing 20, of course, consists of a frame-like body 67 and a flap 68 integrally formed with the upper surface of the body 67.

On the other hand, the retention flange 33 extends inwardly from the web 31 to cooperate with the fastener 19 in holding the cover plate 13 to be fitted in the frame opening 22 defined by the inner frame 12 in position.

The cover plate 13 consists of four ceiling tiles 168 connected together with ribbed splines 40 received between the aligned kerfs 169 formed in the jointing side faces and the end faces of the ceiling tiles, respectively, to thereby provide the cover plate 13.

The pairs of link hinge means 14 allow the inner square frame 12 to pivot or rotate about the center of rotation thereof positioned adjacent to one side of the outer square frame 11 and ensures smooth opening and closing movement of the inner square frame 12 notwithstanding the fact that the frame 12 has the joint finishing flange 32 at the peripheral edge of the frame. As understood from FIGS. 5 through 11, each of the link hinge means 14 comprises a pair of parallel longer links 41, 42, a shorter follower link 43, a link guide 44 and a shorter link or bracket 45 connecting the parallel links 41, 42 together.

The parallel links 41, 42 are pivotally connected by means of pivot pins 46 at the base ends thereof in vertically spaced relationship to the bracket 45, screwed to each of the two opposing sides of the outer frame 11, and at the leading ends to the follower link 43 by means of pivot pins 47. The links 41, 42 are, of course, pivotally connected to the follower link 43 with the same vertical distance as that provided between the base ends of the links 41, 42 where the links are pivotally connected to the bracket 45 by means of the pivot pins 46.

In the pair of parallel links 41, 42, the lower link 42 has a swing control arm 48 extending integrally with and inwardly from the leading end of the link so that when the inner frame 12 is closed the swing control arm 48 is pushed upwardly to the link guide 44 to control the swinging movement of the inner frame 12 with respect to the outer frame 11 to be imparted to the inner frame 12 by the upper and lower parallel links 41, 42 and follower link 43.

The lower edge of the swing control arm 48 is bent towards the outer frame 11 so that when the inner frame 12 opens and closes the arm 48 will not contact the link guide 44 to thereby ensure smooth opening and closing movement of the inner frame. Of course, the bending mode of the swing control arm 48 may be an inclination bending of the entire arm or an offset bending with respect to the lower link 42.

Furthermore, the swing control arm 48 is produced by stamping a length of sheet metal to an outwardly flared shape so that when the inner frame 12 is in its closed position the arm provides an allowance for tightening the packing 20 and also ensures an air-tight seal between the outer and inner frames 11 and 12.

In addition to provide the connection between the leading ends of the parallel links 41, 42 through the pivot pins 46, 47 the follower link 43 has an offset arm 49 integrally formed therewith and extending below the base end of the lower link 42 to pivotally connect the inner frame 12 to the adjacent end of the offset arm 49 through a pin 50.

Figure 6:
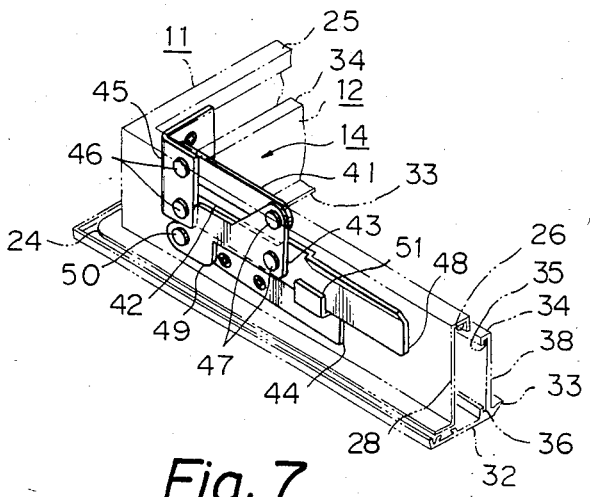
FIG. 6 is a perspective view of the link hinge means employed in said ceiling access door as shown in FIG. 1.
Figure 7:
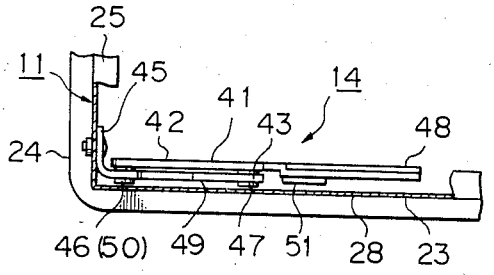
FIG. 7 is a plan view of said link hinge means as shown in FIG. 6.
Figure 8:
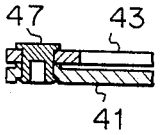
FIG. 8 is a fragmentary cross-sectional view of the joint between the upper link of the parallel links and the follower link in said link hinge means as shown in FIG. 6.
Figure 9:
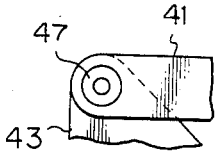
FIG. 9 is a front elevational view of said joint be shown in FIG. 8.

The link guide 44 comprises a yoke 51 which is adapted to receive the swing control arm 48 when the inner frame 12 is in its closed position as shown in FIGS. 6 and 10 and as the inner frame 12 is closing the link guide 44 pushes the swing control arm 48 upwardly with the yoke 51 receiving the arm 48 thereon as shown in FIG. 11 while preventing the arm 48 from deflecting. As a result, the inner square frame 12 is prevented from deflecting with respect to the outer square frame 11 whereby the inner frame is smoothly guided into the frame opening 21 defined by the outer frame 11 and closed.

The bracket 45 is formed by press-bending a stamped steel plate blank to a triangular configuration and screwed to the frame web 23 at the associated corner of the outer square frame 11 to thereby secure the link hinge means 14 to the outer frame 11.

Figure 4:
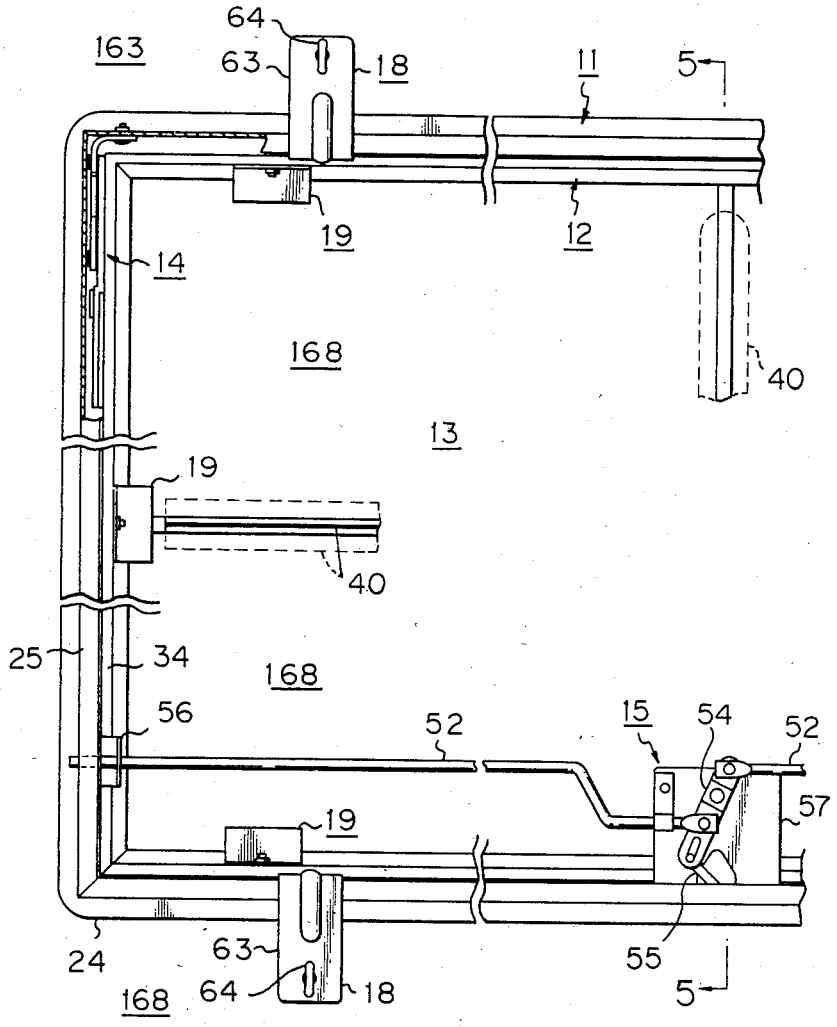
FIG. 4 is a fragmentary plan view on an enlarged scale of said ceiling access door as shown in FIG. 3.

As understood from FIGS. 1, 4 and 5, the locking means 15 is a cremone type lock and comprises a pair of locking rods 52 disposed within the inner frame 12 having the leading ends movably received in the rod guides 56 for extending from the inner frame 12 to the outer frame and retracting from the extended position into the inner frame 12, a pair of rod receiving holes 53 formed in the outer frame 11 for receiving the leading ends of the rods 52, an operation plate 54 rotatably supported on the brackets 57 on the inner frame 12 and connecting the rear ends of the rods 52 together and a crank shaft 55 rotatably attached to the frame web 31 of the inner square frame 12 by means of a bearing 58 for the operation of the operation plate 54 from outside of the inner frame and cover plate assembly 12, 13 and more particularly, of the cover plate 13.

Figure 14:
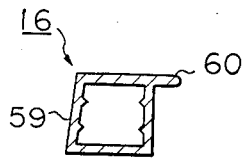
FIG. 14 is a cross-sectional view of one of the trim members forming the trim employed in said ceiling access door as shown in FIG. 1.
Figure 15:
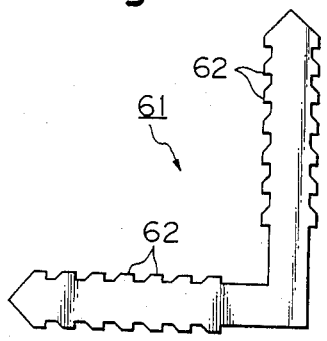
FIG. 15 is a plan view of the corner piece for connecting said trim member as shown in FIG. 14 and another similar trim member together.

As understood from FIGS. 5, 14 and 15, the trim 16 consists of four aluminum alloy flanged trim pieces 59 in the form of an angular tube drawn, cut to a predetermined length and butt-assembled in a square formation. That is, corner pieces 61 are inserted into trim pieces 59 to be butt-assembled and driven to a predetermined position within the trim pieces by hammering.

The corner piece 61 is formed with a plurality of retention means 62 to prevent the corner pieces from coming inadvertently out of the trim pieces 59.

As understood from FIG. 5, the hangers 18 for attaching the ceiling access door 10 to the ceiling framework each comprise a carrier plate 63 holding the outer frame 11 to the associated auxiliary channel member 17 and a threaded clamp bar 64 attaching the carrier plate 63 to the auxiliary channel member 17 so as to clamp the associated cross beam 162 and the associated trim 16 positioned along the associated cross beam 162 and the flange 166 of the associated main beam 161 between the auxiliary channel member 17 and the outwardly extending flange 24 of the outer square frame 11.

The carrier plate 63 is formed at the lower end with a plate-like hook 65 extending along the frame web 23 of the outer square frame 11 and adapted to be received into the receiving groove 26 and at the upper end with a horizontally bent arm 66 including a threaded hole (not shown) for receiving the threaded clamp bar 64. Thus, the carrier plate 63 and threaded clamp bar 64 are assembled as a sub-assembly so that they can be easily assembled to the outer square frame 11.

Next, the installation of the ceiling access door 10 described hereinabove on the building ceiling will be now described hereinbelow. First of all, the auxiliary channel members 17 are bridged between the opposing main beams 161 positioned in the opening 164 in the ceiling, the outer square frame 11 having the trim 16 fitted therein is fitted in the opening 164 so as to place the trim 16 on the outwardly extending frame 24 of the outer frame 11 and the outer square frame 11 is hung from the auxiliary channel members 17 by the four hangers 18 while adjusting the position of the frame 11 with respect to the channel members.

When the outer square frame 11 has been positioned in the opening 164 and secured to the ceiling framework in the manner mentioned hereinabove, since the inner square frame 12 has the cover plate 13, the pairs of link hinge means 14, the cremone lock 15 and the packing 20 assembled thereto previously the inner frame 12 is brought up to the outer square frame 11, the brackets 45 of the link hinge means 14 are screwed to the frame web 23 on one side of the outer square frame 11 and the inner square frame 12 is connected to the outer square frame 11 by means of the link hinge means 14. Therefore, the inner square frame 12 is pivoted upwardly to close the frame opening 21 defined by the outer square frame 11 and the inner square frame and cover plate assembly 12, 13 and more particularly, the cover plate 12 thereof is locked to the outer square frame 11 by the cremone lock 15. In this way, the ceiling access door 10 is installed on the ceiling 160 of a room in the building, but the installation procedure can be varied depending upon the conditions of the room and in other words, depending upon the conditions of the job site where the access door is installed.

And as more clearly shown in FIGS. 1 and 11, when the ceiling access door 10 installed on the ceiling 160 is to be opened, first of all, the cremone lock 15 is unlocked. When the cremone lock 15 has been unlocked, the inner square frame and cover plate assembly 12, 13 and more particularly, the cover plate 13 thereof is allowed to pivot downwardly by its own gravity away from the outer square frame 11 by means of the link hinge means 14 and the door plate 13 further pivots downwardly about the pivot pins 50 from the position as shown in FIGS. 5 and 10 to the position as shown in FIGS. 1 and 11 to open the access door 10. Since the cover plate 13 is allowed to smoothly pivot away from the outer square frame 11 without hitting against the outer frame 11, the frame opening 21 defined by the outer square door frame 11 is fully opened to thereby enable the opening 21 to be utilized to the utmost for access.

Furthermore, even if the cover plate 13 is suddenly released, the cover plate pivots about the pivot pins 50 to alleviate impact which may be inflicted to the ceiling access door 10 to thereby protect the ceiling access door from potential damage and/or deformation.

On the other hand, when the cover is to be closed, first of all, the cover is pivoted upwardly about the pivot pins 50 from the position shown by the solid line to the position shown by the phantom line in FIG. 11 until the yokes 51 of the link guides 44 abut against the swing control arms 48.

After the yokes 51 of the link guides 44 have abutted against the swing control arms 48, as the cover a further upward force is applied to the cover 13 the yokes 51 push the swing control arms 48 upwardly resulting in the upward pivotal movement of the parallel link means 41.

Thus, the cover 13, connected to the parallel links 41, 42 through the follower link 43, is pivoted upwardly into the frame opening 21 defined by the outer square frame 11 to close the opening 21.

Since the swing control arms 48 have allowance for tightening, the arms 48 further raise the cover so as to squeeze the packing 20 so that the cremone lock 15 locks the cover 13 to the outer frame 11.

As the frame opening 21 is closed in the manner mentioned hereinabove, since the yokes 51 of the link guides 44 are received in the swing control arms 48 the inner square frame 12 is held against deflection with respect to the outer square frame 11 and the cover 13 is smoothly closed without causing the cover and more particularly the joint finishing flange 32 thereof to contact the outer square frame and/or the ceiling wall 163.

Figure 16:
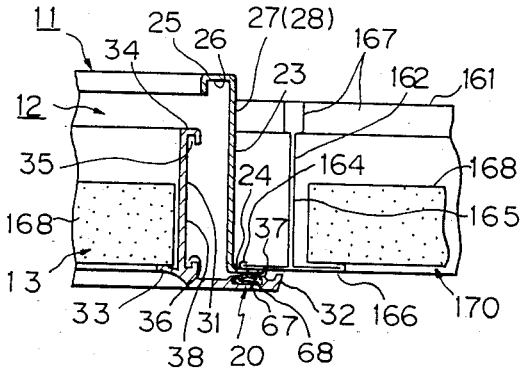
FIG. 16 is a fragmentary cross-sectional view of the ceiling access door of the present invention as applied to a building ceiling constructed by the so-called exposed process.
Figure 17:
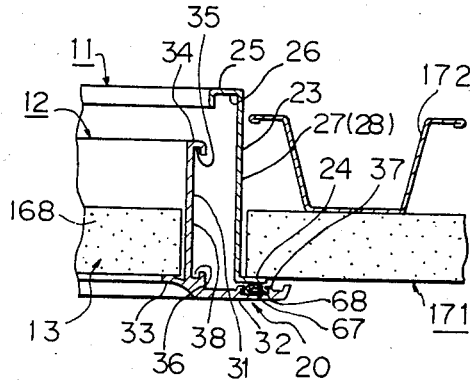
FIG. 17 is a fragmentary cross-sectional view of the ceiling access door as applied to a building ceiling constructed by the so-called dry wall process.

FIGS. 16 and 17 fragmentarily show the ceiling access door 10 of the invention as being applied to the ceilings 170, 171 of office buildings built by the so-called exposed and dry wall processes, respectively. Especially, the ceiling 17 built by the dry wall process as shown in FIG. 17 employs ribbed channel beams 172 in the ceiling framework.

Figure 18:
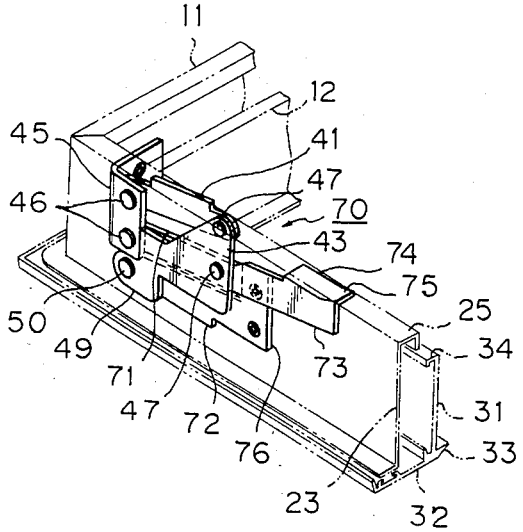
FIG. 18 is a perspective view of a modified link hinge means useful for the ceiling access door of the present invention.
Figure 19:
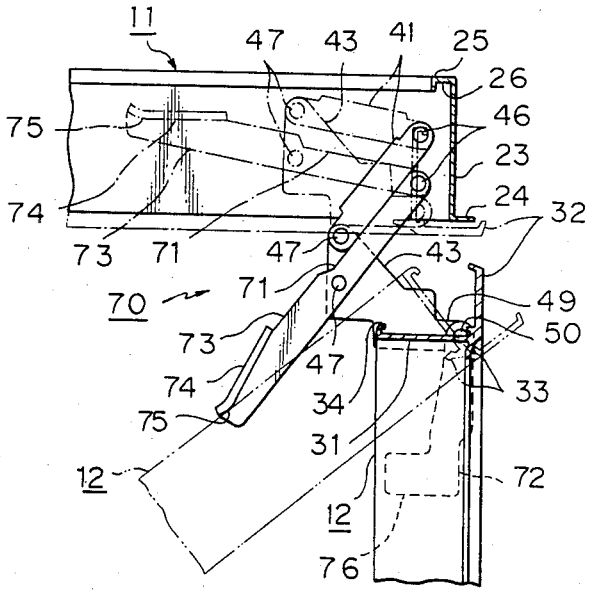
FIG. 19 is a front elevational view of said link hinge means as shown in FIG. 18 when the ceiling access door is in its open position.

FIGS. 18 to 23 inclusive show modified link hinge means 70, 80 and 90 suitably employed in the above-mentioned ceiling access door 10. The link hinge means 70 as shown in FIGS. 18 and 19 comprises a pair of parallel links 41, 71, a follower link 43, a link guide 72 and a bracket 45.

Out of the pair of parallel links 41, 71, the lower link 71 has a swing control arm 73 integrally formed with and extending from the leading end of the link and the swing control arm 73 is formed with a yoke 74 bent towards the inner square frame 12 for receiving the upper end of the frame web 31 on the inner square frame 12 or the inwardly extending flange 34 on the inner frame 12.

The yoke 74 is provided with an arcuate guide face 75 for smooth guidance of the cover 13 as the cover opens and closes.

The link guide 72 comprises an anti-deflection guide 76 at the leading end thereof so as to prevent the lower link 71 and swing control arm 73 from deflecting as the cover opens and closes and also guides the inwardly extending flange 34 on the inner square frame 12 when the cover closes.

The link hinge means 70 having the components arranged as mentioned hereinabove operates in the same manner as the link hinge means 14 employed in conjunction with the above-mentioned ceiling access door 10.

Figure 20:
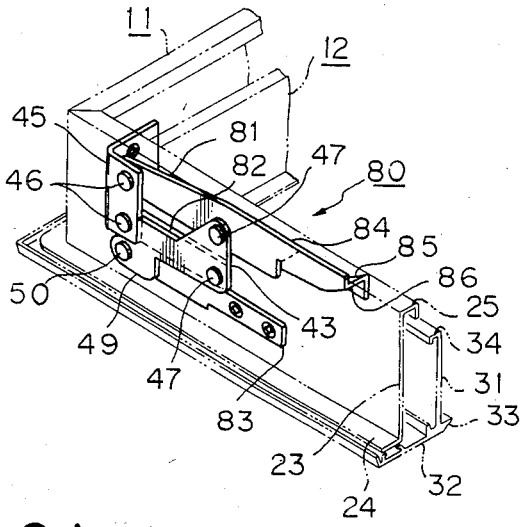
FIG. 20 is a perspective view of a further modified link hinge means useful for the ceiling access door of the present invention.
Figure 21:
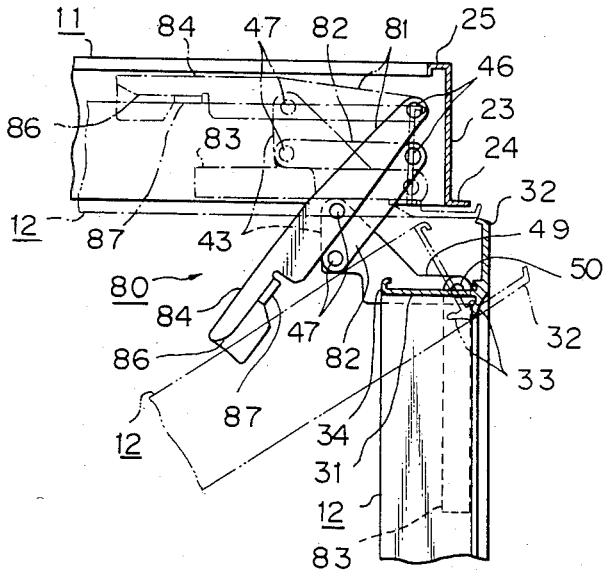
FIG. 21 is a front elevational view of said link hinge means as shown in FIG. 20 when the ceiling access door is in its open position.

The link hinge means 80 as shown in FIGS. 20 and 21 comprises a pair of parallel links 81, 82, a link guide 83 and a bracket 45.

Out of the parallel links 81, 82, the upper link 81 has a swing control arm 84 integrally formed with and extending from the leading end of the link and the arm 84 is formed with a lipped yoke 85 bent towards the inner square frame 12 for receiving the upper end of the frame web 31 or the inwardly extending flange 34 on the inner frame 12.

The yoke 85 is formed with an arcuate guide face 86 for smooth guidance of the cover 13 as the cover opens and closes.

The swing control arm 84 is formed with an anti-deflection means 87 by cutting the arm adjacent to the yoke 85 and the anti-deflection means 87 is bent towards the inner frame 12 to guide the inwardly extending flange 34 on the inner frame 12 to the yoke 85 as the cover closes and also holds the upper link 81 and swing control arm 84 against deflection as the cover closes.

The link hinge means 80 having the components constructed and arranged as mentioned hereinabove also operates in the same manner as the above-mentioned link hinge means 70 does.

Figure 22:
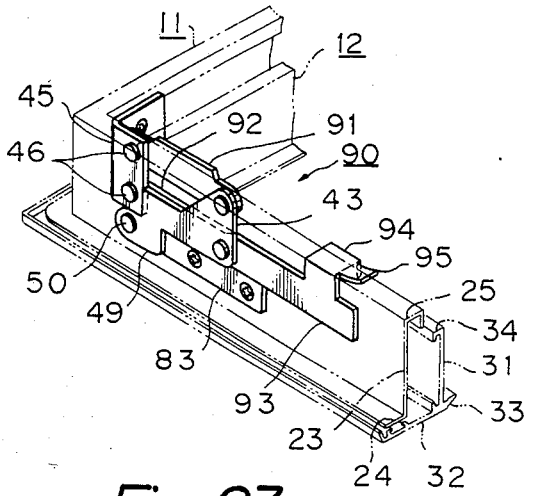
FIG. 22 is a perspective view of a further modified link hinge means useful for the ceiling access door of the present invention.
Figure 23:
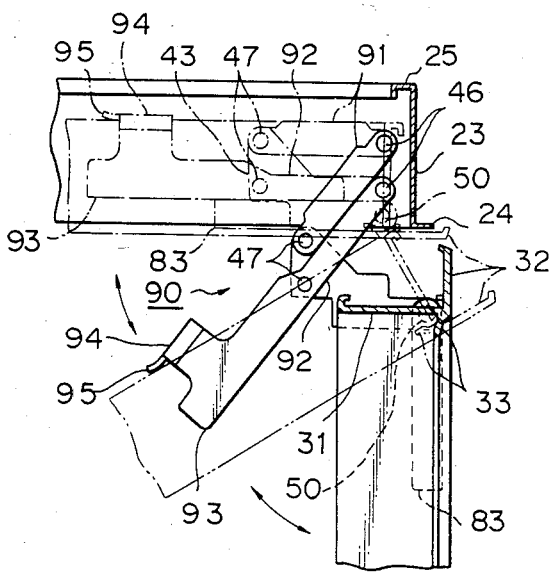
FIG. 23 is a front elevational view of said link hinge means as shown in FIG. 22 when the ceiling access door is in its open position.

The link hinge means 90 as shown in FIGS. 22 and 23 comprises a pair of parallel links 91, 92, a follower link 43, a link guide 83 and a bracket 45.

Out of the pair of parallel links 91, 92, the lower link 92 has a swing control arm 93 integrally formed with and extending from the leading end of the link and the swing control arm 93 is formed with a U-shaped cross-section yoke 94 bent towards the inner square frame 12 for receiving the upper end or the inwardly extending flange 34 of the inner frame 12.

The yoke 94 is formed with an arcuate guide tongue 95 for smooth guidance of the cover as the cover opens and closes.

The link hinge means 90 having the components constructed and arranged as mentioned hereinabove operates in the same manner as the above-mentioned link hinge means 70, 80 do.

FIGS. 24 to 35 show further modified link hinge means 100, 110, 120, 130 and 140 suitably employed in the above-mentioned ceiling access door 10 and theses link hinge means 100, 110, 120, 130 and 140 which are adapted to enable the inner square frame 12 to be detachably connected to the outer square frame 11 in contrast with the above-mentioned link hinge means 14, 70, 80 and 90.

Figure 24:
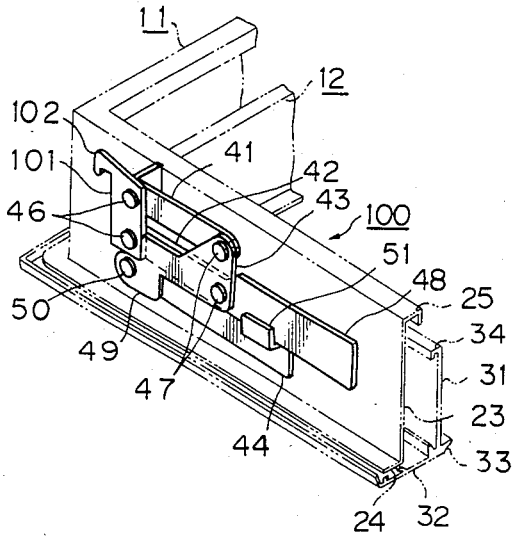
FIG. 24 is a perspective view of a further modified link hinge means useful for the ceiling access door of the present invention.
Figure 25:
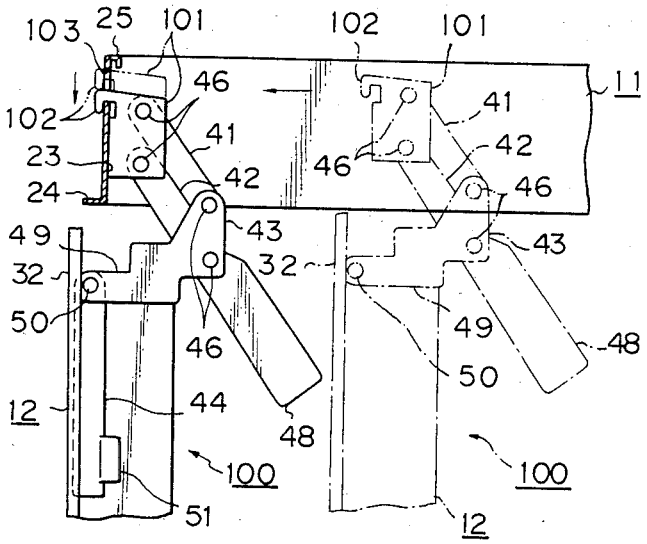
FIG. 25 is a front elevational view of said link hinge means as shown in FIG. 24 when the ceiling access door is in its open position.

The link hinge means 100 as shown in FIGS. 24 and 25 is substantially identical with the above-mentioned link hinge means 14 except that the hinge means 100 comprises a modification of the bracket 45, a pair of parallel links 41, 42, a follower link 43, a link guide 4 and a bracket 101.

The bracket 101 is distinguished from the abovementioned link hinge means 14 by the fact that the bracket 101 is further provided with a notched hook 102.

In connection with the provision of the notched hook 102 on the bracket 101, the frame web 23 at the left and right side corners of one side of the outer square frame 11 (as seen in FIG. 1) is formed with a vertical slots 103. Thus, when the inner frame 12 is to be connected to the outer frame 11, first of all, the inner frame 12 is raised to the position shown by the phantom line in FIG. 25, moved until the bracket 101 comes in contact with the frame web 23 on the outer frame 11 so as to insert the notched hook 102 on the bracket into the vertical slot 103 and then the inner frame 12 is lowered to the solid line position as shown in FIG. 25 whereby the notched hook 102 is hung on the vertical slot 103.

And by reversing the above-mentioned procedure, the inner frame 12 can be simply disconnected from the outer frame 11.

As a result, since the inner frame 12 is temporarily attached to the outer frame 11 and then permanently secured to the outer frame 11 by fastening the bracket 101 of the link hinge means 100, to the outer frame 11 the mounting of the ceiling access door on the ceiling can be quite simply performed and the inner frame and cover plate assembly and more particularly, the cover plate of the assembly can be easily detached from the outer frame 11 for inspection and repair of the piping and wiring systems within the building ceiling without hindering the inspection and repair operation.

Figure 26:
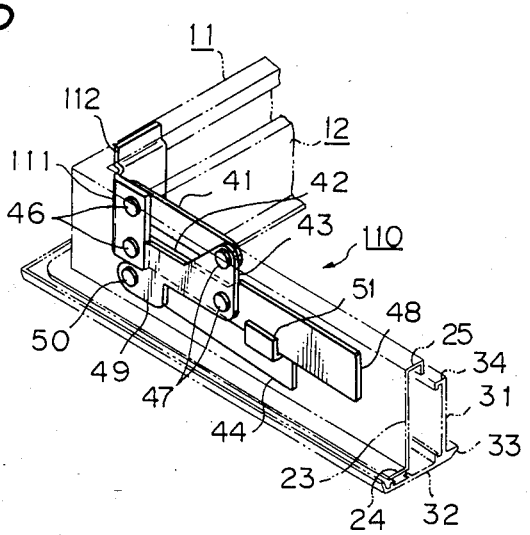
FIG. 26 is a perspective view of a further modified link hinge means useful for the ceiling access door of the present invention.
Figure 27:
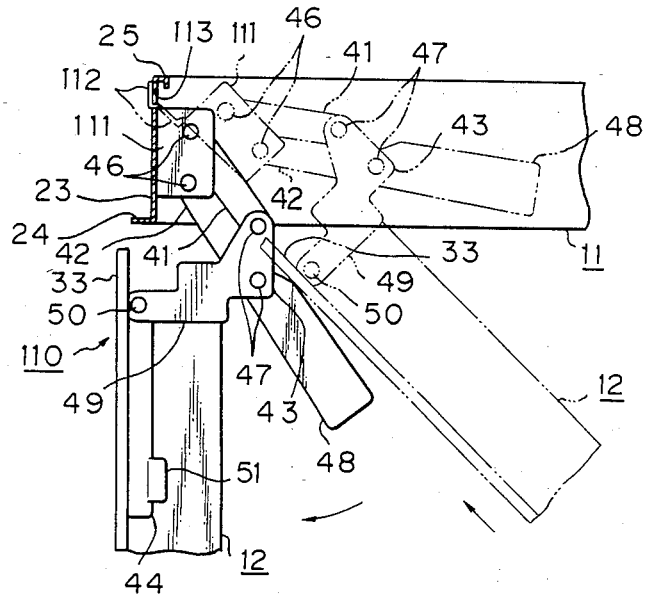
FIG. 27 is a front elevational view of said link hinge means as shown in FIG. 26 when the ceiling access door is in its open position.

FIGS. 26 and 27 show a link hinge means 110 substantially similar to the above-mentioned link hinge means 14 except that the link hinge means 110 is distinguished from the link hinge means 14 by the fact that the link hinge means 110 comprises a modification of the bracket 45 of the link hinge means 14, a pair of parallel links 41, 42, a follower link 43, a link guide 44 and a modified bracket 111.

The modified bracket 111 is distinguished from the above-mentioned bracket 45 by the fact that the bracket 111 is further formed with a hanger tongue 112.

In connection with the provision of the hanger tongue 112 on the bracket 111, the frame web 23 of the outer square frame 11 on one side thereof is formed with a transverse slot 113 at each of the opposite corners of the frame side. Thus, when the inner square frame 12 is to be connected to the outer square frame 11, first of all, the inner frame 12 is raised to the position shown by the phantom line in FIG. 27, moved so as to insert the hanger tongue 112 into the transverse slot 113, rotated to the position as shown by the solid line in FIG. 27 so as to cause the leading end of the hanger tongue 112 to abut against the outer surface of the frame web 23 of the outer frame 11 with the hanger tongue 112 hanging on the transverse slot 113.

By reversing the above-mentioned procedure, the inner frame 12 can be easily disconnected from the outer frame 11.

Figure 28:
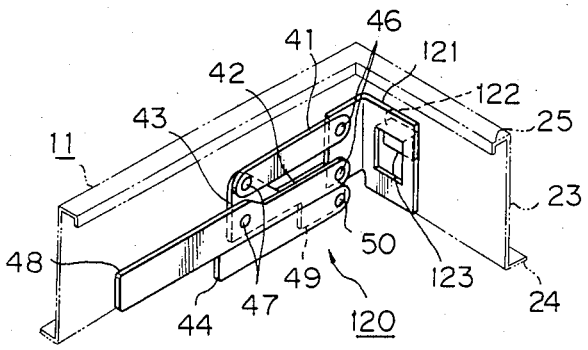
FIG. 28 is a perspective view of a further modified link hinge means useful for the ceiling access door of the present invention.
Figure 29:
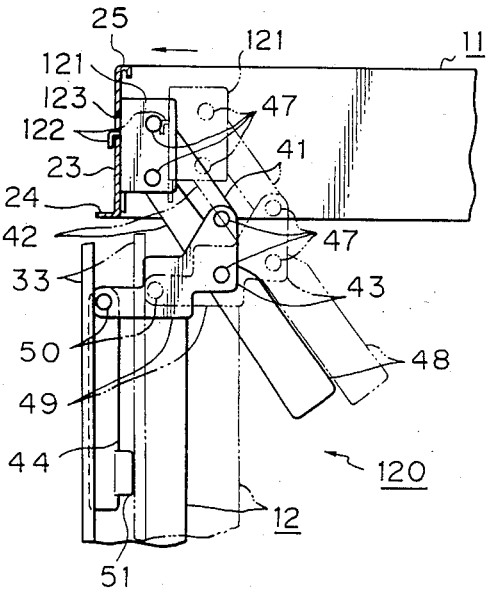
FIG. 29 is a front elevational view of said link hinge means as shown in FIG. 28 when the ceiling access door is in its open position.

The link hinge means 120 as shown in FIGS. 28 and 29 is substantially similar to the above-mentioned link hinge means 14 except that the link hinge means 120 comprises a modification of the above-mentioned bracket 45, a pair of parallel links 41, 42, a follower link 43, a link guide 44 and a modified bracket 121.

The bracket 121 has a lanced or shear-formed hook 122 formed an area of the bracket 45 of the above-mentioned link hinge means 14.

In connection with the provision of the hook 122 on the bracket 121 as mentioned hereinabove, the frame web 23 of the outer square frame 11 with a transverse slot 123 at each of the left- and right-hand corners of the frame 11 is formed.

Thus, the bracket 121 in the link hinge means 120 functions in the same manner as the bracket 101 in the above-mentioned link hinge means 100 does and is engaged into and disengaged from the transverse slot 123.

Figure 30:
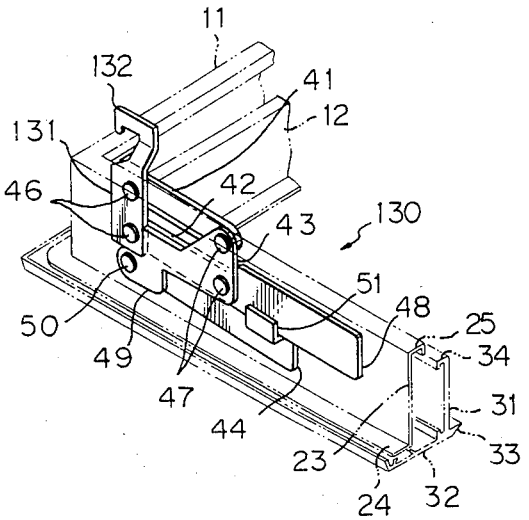
FIG. 30 is a perspective view of a further modified link hinge means useful for the ceiling access door of the present invention.
Figure 31:
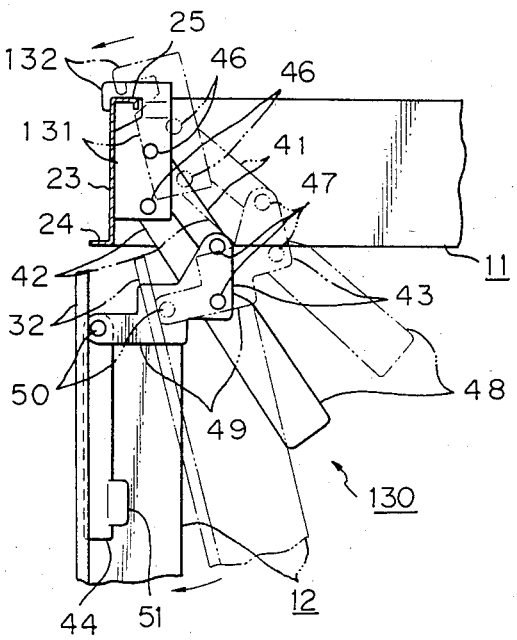
FIG. 31 is a front elevational view of said link hinge means as shown in FIG. 30 when the ceiling access door is in its open position.

The link hinge means 130 as shown in FIGS. 30 and 31 is substantially similar to the above-mentioned link hinge means 14 except that the link hinge means 130 comprises a modification of the bracket 45 of the link hinge means 14, a pair of parallel links 41, 42, a link guide 44 and a modified bracket 131.

The bracket 131 is distinguished from the bracket 45 of the above-mentioned link hinge means 14 by the fact that the bracket 131 is further formed with a notched hook 132. That is, the notched hook 132 is formed in an upper portion of the bracket 131 by pressing for engagement on the upper end of the outer frame 11 and the inwardly extending flange 25 of the outer frame 11 to thereby secure the bracket to the outer frame 11.

By the engagement of the bracket 131 on the outer frame 11 in the manner mentioned hereinabove, the inner frame 12 is connected to the outer frame 11 by means of the link hinge means 130 and easily disconnected from the outer frame.

Thus, by the use of the link hinge means 130 as shown in FIGS. 30, 31, the processing of the outer frame 11 is easier because the processing steps of the slots 103, 113, 123 as required when the above-mentioned link hinge means 100, 110, 120 are employed can be eliminated.

The link hinge means as shown in FIGS. 32 to 35 inclusive is substantially similar to the above-mentioned link hinge means 14 except that the link hinge means 140 comprises a modification of the bracket 45 in the link hinge means 14, a pair of parallel links 41, 42, a follower 43, a link guide 44 and a modified bracket 141.

Although the bracket 141 in the above-mentioned link hinge 130 is adapted to be detachably attached to the outer frame 11 in a direction parallel to the axis of the pivot pins 46, 46, the bracket 141 in the link hinge means 130 is detachably attached to the outer frame 11 in the axial direction of the pivot pins 46, 46. That is, the bracket 141 has been produced by pressing a stamped steel plate blank and is formed in an upper portion a hook 142 and at the front edge with a positioning flange 143. The hook 142 is formed by cutting and pressing the steel plate bracket blank to a shape suitable to be hung on the upper end of the frame web 23 and the inwardly extending flange 25 of the outer frame 11 and the positioning flange 143 is formed by bending the steel plate blank so as to determine the attaching position of the inner frame 12 on the outer frame 11. Especially, the positioning flange 143 is abutted against the frame web 23 of the outer frame 11 and holds the bracket 141 against deflection and rattling when the hook 142 is hung on the outer frame 11.

By the use of the link hinge means 140 having the bracket 141 pressed as mentioned hereinabove, the inner frame 12 is positioned with respect to the outer frame 11 by engaging the bracket 141 on the outer frame 11, sliding the bracket 141 along the outer frame 11 and pressing the positioning flange 143 against the frame web 23 of the outer frame 11 and connected to the outer frame 11 through the link hinge means 140 whereby the inner frame 12 can be easily disconnected from the outer frame 11.

Thus, also in the case of the link hinge means 140, like the above-mentioned link hinge means 130, since the boring step on the outer frame 11 for attachment of the bracket is eliminated the processing of the outer frame 11 is made easier.

Although it has been described that the link hinge means 100, 110, 120, 130 or 140 is detachably connected to the outer frame 11 without the use of rivets in order to secure the bracket 101, 111, 121, 131 or 141 to the outer frame 11, if one rivet is additionally employed to cooperate with the hook, the link hinge means 100, 110, 120, 130 or 140 may firmly connect the cover to the outer frame 11. And even when the cover is connected to the outer frame 11 in the above-mentioned manner, the cover can be easily opened for inspection to repair piping and wiring systems within the building ceiling.

FIG. 36 shows a modified trim 150 which comprises two flanges 60 in contrast with the trim 16 having only one flange 60 and is suitably employed when the ceiling tiles 168 constituting the ceiling wall 163 have slantly cut side and end faces.

As clear from the foregoing description on the preferred embodiment of the access door according to the present invention, in contrast with the conventional access doors for buildings, the access door of the invention comprises the joint forming flange at the peripheral edge of the inner square frame covering the outer square frame so as to conceal the peripheral edge of the outer frame when the inner square frame is in its closed position, the pairs of link hinge means are disposed on two opposing sides of the outer square frame so as to pivotally connect the inner square frame to the outer square frame or the inner frame is movable with the center of rotation of the frame disposed adjacent and parallel to one of the other two sides of the outer square frame. Therefore, the inner square frame and cover plate assembly and more particularly, the cover plate of the assembly can be smoothly opened and closed free of contact with the outer square frame, ceiling, side wall or walls and/or other parts of the building. If the door is abruptly opened, the impact to be applied by the cover to the access door is alleviated to thereby protect the access door against any possible damage and/or deformation. When the cover is opened the whole area of the opening in the access door is exposed whereby inspection and repair operation efficiency is enhanced on the piping, wiring, air-tight parts and other facilities within the building and the single joint finishing structure and air-tight structure can be easily attained. Especially, the components of the access door can be quite easily assembled in the single joint structure so that the access door can be easily applied to ordinary building ceilings, side walls and so on and in addition, the access door can be easily applied to ceiling structures constructed by the so-called exposed and dry wall processes. Furthermore, the access door can be newly installed in addition to existing access doors and removed without difficulty. Still further, since the outer square frame is formed by connecting two outer frame members, each defining one half of the frame opening in the outer frame connected together in butt joint, the rigidity of the outer frame is increased by the use of thin frame members instead of thick frame members as required in the construction of the conventional access doors, air-tightness in the access door is enhanced, the weight of the frame is reduced, construction cost of the frame is reduced and productivity of the access door is enhanced. Furthermore, by the use of the trim the access door can be easily applied to ceiling structures constructed by the so-called exposed, concealed and dry wall processes.

From the foregoing description on the preferred embodiment of the invention referring to the accompanying drawings, various modification and changes in construction will easily occur to those having ordinary knowledge in the art and furthermore, the invention may be embodied in substantially similar modes which fulfill substantially the same purpose and attain substantially the same effects as those described in connection with the preferred embodiment.

What is claimed is:

1. An access door comprising:

an outer square frame adapted to be disposed within an opening formed in an installation area such as a building ceiling or side wall;

an inner square frame having an upper end and an inwardly extending flange, said inner square frame disposed in a frame opening defined by said outer square frame and pivotally connected to said outer square frame for rotation between open and closed positions, said inner square frame having a joint finishing flange at the peripheral edge thereof to conceal a peripheral edge of said outer square frame when said inner square frame is in its closed position;

a cover plate attached to said inner square frame to close a frame opening defined by said inner square frame;

a pair of link hinge means provided on each of two selected sides of said outer square frame to pivotally connect said inner square frame to said outer square frame, said link hinge means each including a pair of parallel upper and lower long links, the leading end of said lower long link having a swing control arm, said swing control arm having a yoke bent toward said inner square frame for receiving said upper end of said inner square frame, a short follower link for pivotally connecting the leading ends of said upper and lower long links, link guide means provided with an anti-deflection guide means for preventing said lower long link and said swing control arm from deflecting as said cover opens and closes and for guiding said inwardly extending flange of said inner square frame as said cover closes, and a bracket connecting said upper and lower long links together and securing said link hinge means to said outer square frame; and a locking means adapted to lock said inner square frame to said outer square frame when said inner square frame is in its closed position.

2. The access door of claim 1, wherein said yoke is formed into a lipped yoke bent toward said inner square frame for receiving said upper end of the inner square frame.

3. The access door of claim 1, wherein said yoke is formed into a U-shaped cross-section yoke bent toward said inner square frame for receiving said upper end of said inner square frame.

4. The access door of claim 1, wherein said outer square frame comprises two frame members which are connected together by butt joints, each of said joints comprising a connector tongue attached to one frame member and alanced bridge attached to the other frame member for holding said two frame members together, each frame member defining one half of the frame opening defined by said outer square frame.

* * * * *